US007392855B1

(12) United States Patent
White

(10) Patent No.: US 7,392,855 B1
(45) Date of Patent: Jul. 1, 2008

(54) VIBRATORY PILE DRIVING SYSTEMS AND METHODS

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 11/413,039

(22) Filed: Apr. 26, 2006

Related U.S. Application Data

(60) Provisional application No. 60/675,524, filed on Apr. 27, 2005.

(51) Int. Cl.
*E02D 7/12* (2006.01)

(52) U.S. Cl. ..... 173/49; 173/91; 173/135; 173/206; 173/210; 405/232; 175/56

(58) Field of Classification Search ..... 173/49, 173/152, 193, 141, 186, 187, 42, 44, 189, 173/91, 210, 211, 162.1, 135, 206; 405/231, 405/232, 249, 253, 228; 175/56
See application file for complete search history.

(56) References Cited

U.S. PATENT DOCUMENTS

| | | | | | |
|---|---|---|---|---|---|
| 3,106,258 | A | * | 10/1963 | Muller | 175/55 |
| 3,115,198 | A | * | 12/1963 | Kuss | 173/127 |
| 3,786,874 | A | * | 1/1974 | Jodet et al. | 173/49 |
| 4,033,419 | A | * | 7/1977 | Pennington | 173/34 |
| 5,004,055 | A | * | 4/1991 | Porritt et al. | 175/20 |
| 5,117,925 | A | | 6/1992 | White | |
| 5,213,449 | A | | 5/1993 | Morris | |
| 5,263,544 | A | | 11/1993 | White | |
| 5,281,775 | A | * | 1/1994 | Gremillion | 181/116 |
| 5,355,964 | A | | 10/1994 | White | |
| 5,540,295 | A | * | 7/1996 | Serrette | 175/56 |
| 5,544,979 | A | | 8/1996 | White | |
| 5,562,169 | A | * | 10/1996 | Barrow | 175/56 |
| 5,609,380 | A | | 3/1997 | White | |
| 5,653,556 | A | | 8/1997 | White | |
| 5,794,716 | A | | 8/1998 | White | |

(Continued)

FOREIGN PATENT DOCUMENTS

EP 0172960 A1 3/1986

(Continued)

OTHER PUBLICATIONS

"Castle Board Drain Method", Japanese brochure, Reference Nos. APE00857 through APE00863, Aug. 1976.

(Continued)

*Primary Examiner*—Scott A. Smith
(74) *Attorney, Agent, or Firm*—Michael R. Schacht; Schacht Law Office, Inc.

(57) ABSTRACT

A drive system for driving and/or extracting an elongate member. The drive system comprises a piston drive assembly, a hydraulic system, and a vibration drive assembly. The piston drive assembly comprises a piston member, and the piston member engages the elongate member. The hydraulic system is operatively connected to the piston drive assembly to apply a drive force to the piston member. The vibration drive assembly generates a vibratory force. The vibration drive assembly is operatively connected to the piston drive assembly. The drive system operates in a first mode in which the drive force and the vibratory force are applied to the piston member along a drive axis.

8 Claims, 2 Drawing Sheets

U.S. PATENT DOCUMENTS

| | | | | |
|---|---|---|---|---|
| 5,811,741 | A * | 9/1998 | Coast et al. | 181/101 |
| 6,039,508 | A | 3/2000 | White | |
| 6,129,159 | A * | 10/2000 | Scott et al. | 175/55 |
| 6,179,527 | B1 * | 1/2001 | Goughnour | 405/232 |
| 6,427,402 | B1 | 8/2002 | White | |
| 6,431,795 | B2 | 8/2002 | White | |
| 6,447,036 | B1 | 9/2002 | White | |
| 6,543,966 | B2 | 4/2003 | White | |
| 6,557,647 | B2 | 5/2003 | White | |
| 6,648,556 | B1 | 11/2003 | White | |
| 6,672,805 | B1 | 1/2004 | White | |
| 6,732,483 | B1 | 5/2004 | White | |
| 6,736,218 | B1 | 5/2004 | White | |
| 6,896,448 | B1 | 5/2005 | White | |
| 6,908,262 | B1 | 6/2005 | White | |
| 6,942,430 | B1 * | 9/2005 | Suver | 405/252.1 |
| 6,988,564 | B2 | 1/2006 | White | |
| 7,168,890 | B1 | 1/2007 | Evarts | |

FOREIGN PATENT DOCUMENTS

| | | | |
|---|---|---|---|
| EP | 0526743 | A1 | 8/1995 |
| FR | 838717 | | 3/1939 |
| FR | 2560247 | | 2/1984 |
| GB | 2003769 | A | 8/1978 |
| GB | 2023496 | A | 5/1979 |
| GB | 2060742 | A | 5/1981 |
| GB | 2028902 | B | 8/1982 |
| JP | 02-58627 | A | 2/1990 |
| JP | 6-136751 | A | 5/1994 |
| KR | 92-16944 | | 9/1992 |
| NL | 42349 | | 12/1937 |
| NL | 65252 | | 1/1950 |
| NL | 7707303 | | 7/1977 |
| NL | 7710385 | | 9/1977 |
| NL | 7805153 | | 5/1978 |
| SU | 1027357 | A | 7/1983 |
| WO | WO 8707673 | | 12/1987 |
| WO | WO 8805843 | | 8/1988 |

OTHER PUBLICATIONS

"The 1st Report on the Treatment of Soft Foundation of Juck Hyun Industrial Site", Ref. Nos. APE00854 through APE00856, Mar. 1976. Korean document, Ref. Nos. APE00864 through APE00891, 1982-1997.

* cited by examiner

VIBRATORY PILE DRIVING SYSTEMS AND METHODS

RELATED APPLICATIONS

This application claims priority of U.S. Provisional Patent Application Ser. No. 60/675,524 filed Apr. 27, 2005. The contents of all related applications listed above are incorporated herein by reference.

TECHNICAL FIELD

The present invention relates to methods and apparatus for inserting rigid members into or extracting rigid members from the earth and, more particularly, to systems and methods for driving and/or extracting a pile.

BACKGROUND OF THE INVENTION

For certain construction projects, rigid members, such as piles, anchor members, caissons, sheet pile barriers, and mandrels for inserting wick drain material, must be placed into the earth. The term "piles" will be used herein to refer to the rigid members typically driven into the earth during construction projects. It is well-known that such rigid members may often be driven into or extracted from the earth without excavation by applying a driving or extracting force on an upper end of the pile.

To drive or extract a pile, a driving force is typically applied to the pile along a longitudinal axis A of the pile. The driving force may be created in various ways. A drop hammer comprises a ram member that is repeatedly raised and dropped such that the impact of the ram member drives the pile into the earth. A diesel hammer comprises a ram member that compresses and ignites fuel between the ram member and the pile; the impact of the ram member drives the pile, while expansion of the ignited fuel both drives the pile into the earth and raises the drop hammer for the next impact. A hydraulic drive system uses a hydraulic ram to force or crowd the pile into the earth. A crane may be used to apply an extraction force on a pile through a cable.

In addition, vibratory forces may be applied to the pile. Vibratory forces are also applied along the longitudinal axis A of the pile, typically in combination with a passive driving force created by the weight of the vibration equipment on top of the pile. The combination of the passive driving force and the vibratory forces is often sufficient to drive a pile in certain soil types. Typically, a suppressor is used to isolate support equipment such as a crane or the like from the vibratory forces.

Attempts have been made to combine vibratory forces with active driving forces such as a hydraulic drive system. U.S. Pat. Nos. 6,039,508 and 6,431,795 to White disclose systems and methods for inserting wick drain material comprising a bottom drive system that combines a vibratory device with a gear drive to drive a mandrel supporting the wick drain mater. The gear drive crowds the mandrel into the earth, and the vibratory device is operated to assist the gear drive under some soil conditions.

The need exists for improved vibratory pile driving systems and methods.

SUMMARY OF THE INVENTION

The present invention may be embodied as a drive system for driving and/or extracting an elongate member. The drive system comprises a piston drive assembly, a hydraulic system, and a vibration drive assembly. The piston drive assembly comprises a piston member, and the piston member engages the elongate member. The hydraulic system is operatively connected to the piston drive assembly to apply a drive force to the piston member. The vibration drive assembly generates a vibratory force. The vibration drive assembly is operatively connected to the piston drive assembly. The drive system operates in a first mode in which the drive force and the vibratory force are applied to the piston member along a drive axis.

DETAILED DESCRIPTION OF THE INVENTION

Figure 1:
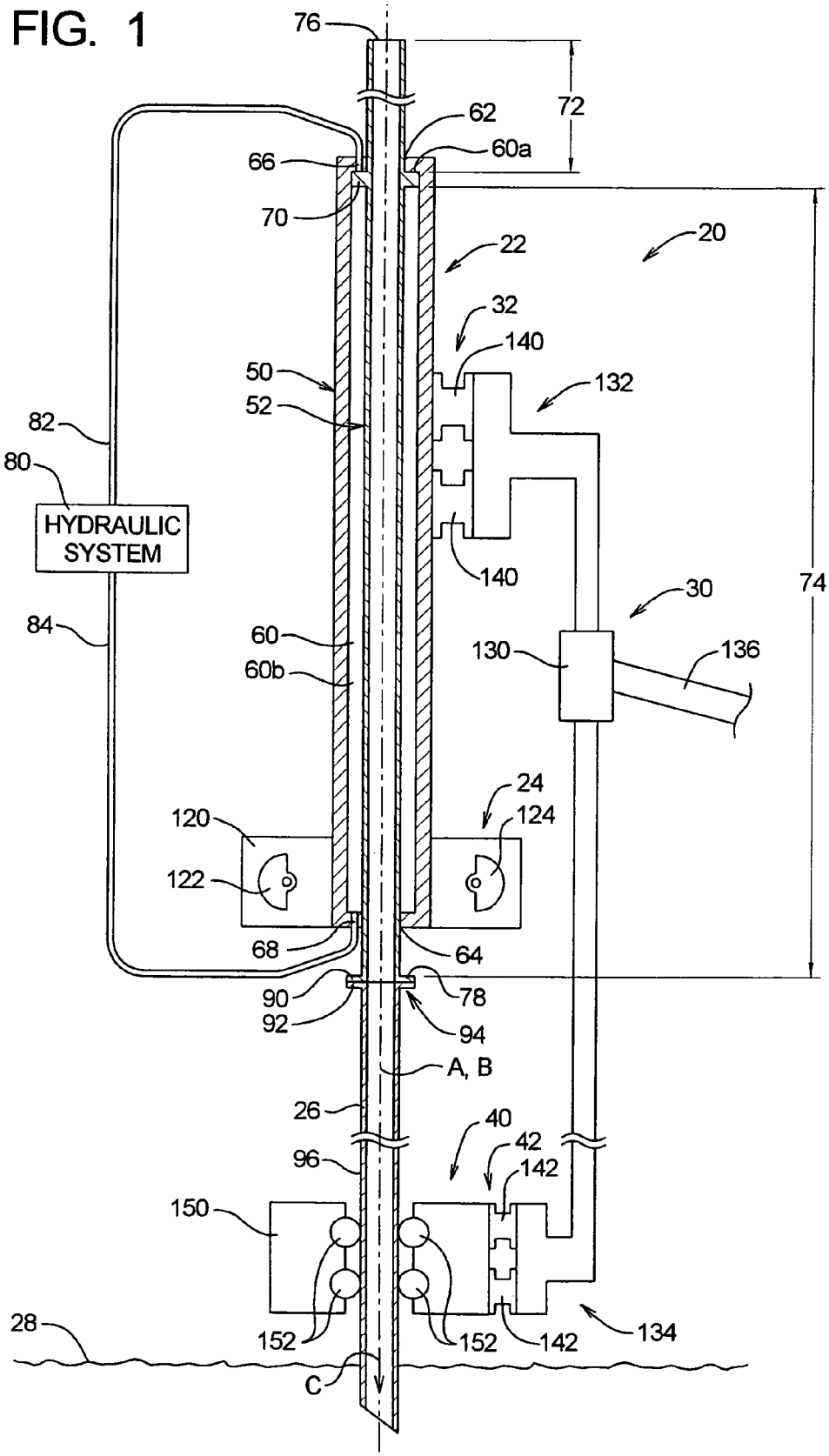
FIGS. 1 and 2 are somewhat schematic side, elevation, partial sectional views of a vibratory pile driver of the present invention.
Figure 2:
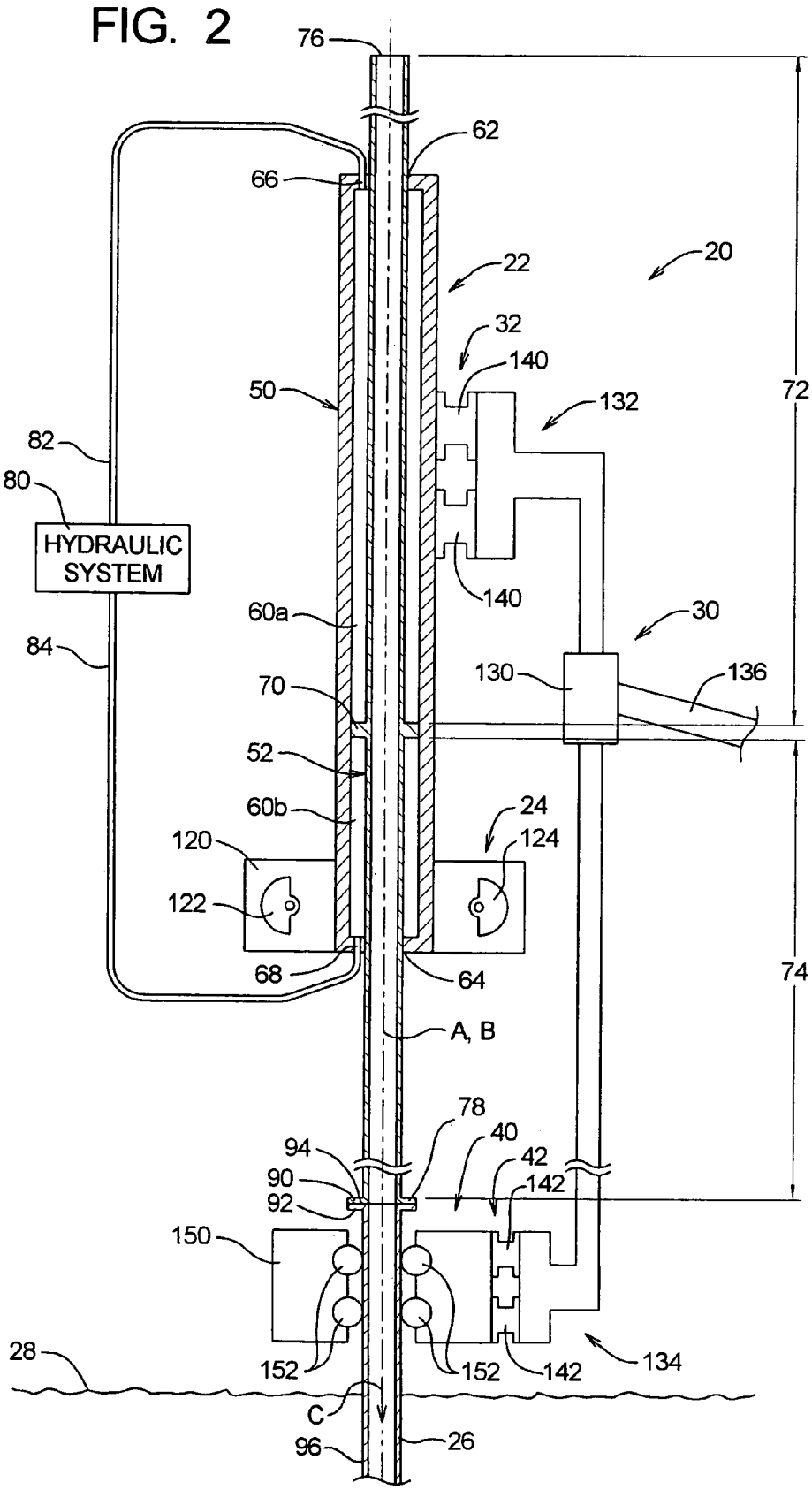

Referring to FIGS. 1 and 2 of the drawing, depicted therein is a pile driving system 20 constructed in accordance with, and embodying, the principles of the present invention. The pile driving system 20 comprises a piston drive assembly 22 and a vibration drive assembly 24 and is adapted to drive a pile 26 into the earth 28.

In the example use of the system 20 depicted in FIGS. 1 and 2, the drive assemblies 22 and 24 are connected to a support structure 30 by a first suppressor system 32. In addition, a guide system 40 is connected to the support structure 30 by a second suppressor system 42.

In use, the piston drive assembly 22 applies a constant downward or upward driving force on the pile 26 along a drive axis B that is substantially aligned with the pile axis A. The vibration drive assembly 24 generates vibration forces that are also aligned with the drive axis B. In some soil conditions, the piston drive assembly 22 can be used alone. In other soil conditions, the driving force of the piston drive assembly 22 is combined with the vibratory forces of the vibration drive assembly 24 to facilitate driving of the pile 26.

The support system 30 may take many different forms but should be of sufficient strength to support the weight of the pile driving system 20, the pile 26, and any associated equipment such as the guide system 40 and the suppressor systems 32 and 42. Preferably, the support system 30 allows the pile driving system 20 and pile 26 to be moved to an appropriate location and angle relative the ground 28. The first suppressor system 32 also is or may be conventional and inhibits the transmission of the vibration forces generated by the vibration drive assembly 24 to the support system 30.

The example support system 30 is attached to the boom of a spotter or excavator as conventionally used in the construction industry. The spotter or excavator is a vehicle that can be moved along the ground and which also allows rotation of the pile driving system 20 and pile 26 about a horizontal axis of rotation.

The guide system 40 is optionally used to guide the pile 26 as the pile 26 is driven into the earth 28. In particular, the guide system 40 is connected to the support system 30 such that guide system 40 helps maintain the axis A of the pile 26 in substantial alignment with the drive axis B defined by the pile driving system 20. The second suppressor system 42 also is or may be conventional and inhibits the transmission of the vibration forces generated by the vibration drive assembly 24 to the support system 30 through the guide system 40.

With the foregoing general understanding of the operation of the present invention in mind, the details of construction and operation of the example pile driving system 20 will now be described.

The piston drive assembly 22 comprises a piston housing 50 and a piston member 52. The piston housing 50 defines a piston chamber 60, first and second shaft openings 62 and 64, and first and second ports 66 and 68. The piston member 52 comprises a piston flange 70 and first and second shaft portions 72 and 74. The first and second shaft portions 72 and 74 define first and second distal ends 76 and 78. The second distal end 78 is adapted to engage the pile 26. The example piston member 52 is steel and is depicted as being a hollow tube, but the piston member 52 may be made of different materials and in other forms.

The piston member 52 is arranged such that the piston flange 70 is within the piston chamber 60 and the first and second shaft portions 72 and 74 extend through the first and second shaft openings 62 and 64, respectively. The first and second shaft openings 62 and 64 are sealed substantially to prevent fluid flow through these openings 62 and 64 during normal operation of the system 20.

When the system 20 is assembled, the distal ends 76 and 78 of the piston member 52 are located outside of the piston chamber 60. In addition, the piston flange 70 divides the piston chamber 60 into first and second chamber portions 60*a* and 60*b*. The first port 66 is configured to allow fluid flow into and out of the first chamber portion 60*a*, while the second port 68 is configured to allow fluid flow into and out of the second chamber portion 60*b*.

A hydraulic system 80 is connected by first and second fluid conduits 82 and 84 to the first and second ports 66 and 68, respectively. The hydraulic system 80 is configured to force hydraulic fluid into either of the chamber portions 60*a* or 60*b* to displace the piston member 52 relative to the piston housing 50. In particular, fluid forced into the first chamber portion 60*a* acts on the piston flange 70 to cause the piston member 52 to move in a direction indicated by arrow C in FIGS. 1 and 2; fluid forced into the second chamber portion 60*b* acts on the piston flange 70 to cause the piston member 52 to move in a direction opposite to that indicated by arrow C.

The volumes of the first and second chamber portions 60*a* and 60*b* change in inverse proportion to each other as the piston member 52 moves. The hydraulic system 80 is thus configured to allow fluid to flow out of the non-pressurized chamber portion 60*a* or 60*b* back to the hydraulic system 80 as the piston member 52 is displaced as described above.

The second end 78 of the piston member 52 engages the pile 26 such that the driving and vibratory forces are applied along the pile axis A. Typically, the second end 78 is clamped or otherwise connected to the pile 26 such that the vibratory forces are effectively transmitted from the piston member 52 to the pile 26. In the example system 20 depicted in FIGS. 1 and 2, the second end 78, defines a flange 90 that is bolted or otherwise secured to a similar flange 92 formed on an exposed end 94 of the pile 26. However, the second end 78 may be clamped to the exposed pile end 94 or elsewhere to a side surface 96 of the pile 26. In some situations, it may be possible for the second end 78 not to be connected to the pile 26.

Referring now to the vibration drive assembly 24, the vibration drive assembly 24 is attached to or otherwise rigidly fixed relative to the piston housing 50 as shown in FIGS. 1 and 2 or possibly to the piston member 52. If attached directly to the piston member 52, the vibratory forces are directly transmitted to the piston member 52.

When attached to the piston housing 50, the vibratory forces generated by the vibration drive assembly 24 are transmitted to the piston housing 50 and through the hydraulic fluid within the piston chamber 60 to the piston member 52. For maximum transmission of vibratory forces through the hydraulic fluid, the hydraulic system 80 is configured to prevent fluid flow through either of the ports 66 or 68. However, the vibration drive system 24 may be operated with one or both of the ports 66 and 68 open as may be required to operate piston drive assembly 22.

The vibration drive assembly 24 is or may be conventional and is depicted in FIGS. 1 and 2 as comprising a vibro housing 120 and first and second counter-rotating eccentric weights 122 and 124. The vibro housing 120 may take many forms but should at a minimum have structure that allows it to be rigidly attached to the piston housing 50 or piston member 52. The vibro housing 120 should also provide structure for rotatably supporting the eccentric weights 122 and 124.

The eccentric weights 122 and 124 can take different forms but typically comprise an axle portion and a weight portion, where the center of gravity of the weight portion is offset from the axis of the axle. Typically, the axle is rotated by a hydraulic motor. More than two weights can be provided, but the weights should be balanced such that, when counter-rotated, lateral forces are canceled and drive forces are summed.

The support structure 30 can take many different forms and is only highly schematically represented in FIGS. 1 and 2. The support structure will typically take the form of a rigid metal structure having a coupler portion 130, a first support portion 132, and a second support portion 134. The coupler portion 130 is adapted to be connected to a boom 136 of a spotter, excavator, crane, or the like. The first support portion 132 is adapted to be connected to the first suppressor system 32.

The example first suppressor system 32 comprises a plurality of elastic members 140 that are connected between the first support portion 132 and either the piston housing 50 as shown or the piston member 52. The elastic members 140 resiliently oppose movement of the pile driving system 20 relative to the support structure 30 to inhibit transmission of shocks from the pile driving system 20 to the support structure 30.

The second support portion 134 is adapted to be connected to the second suppressor system 42. As will be described below, the guide system 40 engages the pile 26 such that vibrations on the pile 26 may be transmitted to the guide system 40. The example second suppressor system 42 also comprises a plurality of elastic members 142; the elastic members 142 are connected between the second support portion 134 and the guide system 40. The elastic members 140 and 142 resiliently oppose movement of the guide system 20 relative to the support structure 30 to inhibit transmission of shocks from the guide system 40 to the support structure 30.

The guide system 40 comprises a guide housing 150 and guide members 152. The guide housing 150 supports the guide members 152 to engage the pile 26 such that the axis A of the pile 26 is substantially aligned with the drive axis B as shown in FIGS. 1 and 2. The guide members 152 may be formed by rollers, gears, bumpers, or the like that engage opposing portions of the side surface 96 of the pile 26. Four guide members 152 are depicted in FIGS. 1 and 2, but typically an additional four guide members will be arranged to engage the pile 26 in a plane orthogonal to the plane in which the depicted guide members lie.

From the foregoing, it should be clear that the present invention may be embodied in forms other than the form described above. The above-described embodiment is therefore to be considered in all respects illustrative and not restrictive.

What is claimed is:

1. A drive system for driving and/or extracting an elongate member, comprising:

a support structure;

a piston drive assembly comprising a piston member, where the piston member engages the elongate member;

a hydraulic system operatively connected to the piston drive assembly, where the hydraulic system is capable of applying a drive force to the piston member, where the hydraulic system comprises a piston housing defining a housing chamber, the piston member further comprises a piston flange that divides the housing chamber into first and second portions, and the hydraulic system is operatively connected to the first and second portions of the housing chamber;

a vibration drive assembly capable of generating a vibratory force, where the vibration drive assembly is operatively connected to the piston drive assembly;

a first suppresser system operatively connected between the support structure and the vibration drive assembly, where the suppressor system resiliently opposes transfer of vibratory forces from the vibration drive assembly to the support structure;

a guide system for guiding the elongate member along the drive axis; and a second suppresser system operatively connected between the support structure and the guide system, where the suppressor system resiliently opposes transfer of vibratory forces from the guide system to the support structure; wherein the drive system operates in a first mode in which the drive force and the vibratory force are applied to the piston member along a drive axis, and a second mode in which the drive force is applied to the piston member along the drive axis.

2. A drive system as recited in claim 1, in which the drive force drives the elongate member into the earth.

3. A drive system as recited in claim 1, in which the drive force withdraws the elongate member from the earth.

4. A drive system as recited in claim 1, in which the vibration drive assembly comprise counter-rotating eccentric weights.

5. A drive system for driving and/or extracting an elongate member, comprising:

a support structure;

a piston housing defining a piston chamber;

a piston member arranged at least partly within the piston chamber, where the piston member comprises a piston flange that defines first and second chamber portions of the piston chamber, is displaceable along a drive axis relative to the piston housing, and is adapted to be rigidly connected to the elongate member;

a hydraulic system operatively connected to the piston chamber, where the hydraulic system is capable of applying a drive force to the piston member to displace the piston member along the drive axis relative to the housing;

a vibration drive assembly operatively connected to the piston housing, where the vibration drive assembly is capable of applying a vibrational force on the piston housing substantially along the drive axis;

a guide system for guiding the elongate member along the drive axis;

a first suppresser system operatively connected between the support structure and the piston housing, where the suppressor system resiliently opposes transfer of vibratory forces from the piston housing to the support structure; and a second suppresser system operatively connected between the support structure and the guide system, where the suppressor system resiliently opposes transfer of vibratory forces from the guide system to the support structure wherein the drive system operates in a first mode in which the drive force and the vibratory force are applied to the piston member along a drive axis; and a second mode in which the drive force is applied to the piston member along the drive axis.

6. A drive system as recited in claim 5, in which the drive force drives the elongate member into the earth.

7. A drive system as recited in claim 5, in which the drive force withdraws the elongate member from the earth.

8. A drive system as recited in claim 5, in which the vibration drive assembly comprise counter-rotating eccentric weights.

* * * * *